United States Patent [19]

Kinnard

[11] Patent Number: 4,507,885

[45] Date of Patent: Apr. 2, 1985

[54] ALBUM ASSEMBLY

[76] Inventor: Wolcott S. Kinnard, 5822 W. Fon Du Lac Ave., Milwaukee, Wis. 53218

[21] Appl. No.: 365,935

[22] Filed: Apr. 5, 1982

[51] Int. Cl.[3] ..... G09F 11/06

[52] U.S. Cl. ..... 40/405; 40/537; 40/338; 40/154

[58] Field of Search ..... 40/530, 537, 405, 401, 40/400, 399, 391, 388, 154; 24/257, 259 R; 281/21 R, 23, 15, 16, 17

[56] References Cited

U.S. PATENT DOCUMENTS

| | | | |
|---|---|---|---|
| 886,320 | 4/1908 | Ferrero | 40/405 |
| 3,367,340 | 2/1968 | David et al. | 40/401 |
| 3,460,282 | 8/1969 | Swirsky | 40/154 |
| 3,624,873 | 12/1971 | Frey | 24/259 R |
| 3,651,591 | 3/1972 | Woodyard | 40/537 |
| 3,956,836 | 5/1976 | Seaborn | 40/530 |
| 4,140,565 | 2/1979 | Parker et al. | 40/154 |
| 4,294,029 | 10/1981 | Holson | 40/388 |

FOREIGN PATENT DOCUMENTS

| | | | |
|---|---|---|---|
| 1000074 | 2/1952 | France | 40/405 |
| 1184884 | 3/1970 | United Kingdom | 40/405 |

*Primary Examiner*—John J. Wilson
*Assistant Examiner*—James R. Hakomaki

[57] ABSTRACT

A thermoplastic album page molded as a single piece, includes an integral flap and is assembled with other such pages to form a bound album. The resulting album requires no extrinsic binding hardware, locks each photograph or other displayed item in place within a page, and permits an album of any thickness to be assembled and to be opened flat to any page.

8 Claims, 16 Drawing Figures

ALBUM ASSEMBLY

TECHNICAL FIELD

One aspect of the present invention is an album page, a plurality of which can be bound together to form an album. Another aspect of the invention is improved hinging, binding, and mounting means for such albums. Still another aspect of the invention is a mold assembly for forming such pages and their binding means in one piece from thermoplastic material.

BACKGROUND ART

Several ways of binding display pages together to form albums are known. Ring or spiral binders require a binding of suitable size to accommodate the number of pages required. Page clamping binders—including ordinary book bindings and the so-called "perfect binding" in which the pages are fused or glued together along one edge—have limited flexibility, and part of the sight area of each page is obscured in the fold of the binding. Bindings including a hinge for each page are also known, as are bindings having a hinge leaf secured to each page for being joined by hinge pins to the hinge leaves of the preceding and following pages. All of the binding devices described above have either the disadvantage of requiring loose hardware to bind the leaves together or the disadvantage of less than 180 degree rotation of each leaf about its hinge when opening and closing the album or turning its pages.

Another problem in the art is how to most economically form album pages and their associated binding, picture mounting, and hinge assemblies. Previously, most album pages have been assembled from one or more raw material sheets using relatively expensive sheet handling, folding, and joining apparatus. Binding hardware and picture mountings have been separately manufactured, using different machinery. Thus, a considerable capital investment has previously been required to manufacture and assemble the parts of an album, and album assemblers have had to keep an inventory of each required part on hand.

SUMMARY OF THE INVENTION

A primary object of the present invention is to provide an album assembly comprising pages equipped with interlocking means for being assembled. Collateral objects of the invention are to provide an album requiring no picture mounting or binding hardware other than integral parts of the pages, to provide a binding which allows the album to be opened flat, and to provide album pages which are moldable as one piece, which is then further processed to provide integral binding and hinge means. Other objects of the invention will become apparent from the description which follows.

The present album page comprises joined leaves or slotted frame elements defining a pocket or slot between them for receiving objects to be viewed. The page has at least one window to expose an object within it for viewing, and preferably two windows occupying nearly the entire area of each leaf or the area within the frame elements. A flap secured to one edge of the page by a hinge includes means for being fastened to the edge of another such page. As each page can be joined to the succeeding one, an album of any size can be created. Each page has an independent hinge which is capable of bending 180 degrees or more, and only one hinge is flexed to open the volume to a particular page. The album pages thus do not interfere with each other when the album is opened or closed. In the preferred page the flap is insertable into the mouth of the succeeding page (through which a picture has previously been inserted) and secured there by snap fittings. The page can be formed by injection molding a single piece which is then further worked to form its integral hinge and binding and picture securing elements.

Another aspect of the invention is a mold assembly for forming a one-piece molding of the type described. The mold assembly comprises first and second mold portions which come together at a parting line to define a cavity for forming the outside of a page and its peripheral elements; a slide for being urged transversely between the mold portions, displacing material within the cavity to form a pocket or slot for receiving a picture; injection means for filling the cavity with a moldable material such as a thermoplastic resin; and stripping means for opening the mold and removing the completed molding. Windows are formed in the molding by providing lands on the mold portions which bear against the slide during molding. In a preferred mold assembly at least one gate perforates the slide for improving the distribution of material in the mold, and the material within the gate is sheared off when the slide is removed from the mold so the parts of the molding are joined only at three edges when the mold is opened and the slide is withdrawn.

Another aspect of the invention is a method for forming a registered pair of bosses, each having a negative draft, extending from the respective surfaces of a molded sheet. In the context of the album page of this invention, such a structure is useful in making a snap fitting for joining the flap of one page to the body of the next one to form an album. The method comprises the steps of molding such a sheet having at least one boss extending from one of its surfaces, placing the at least one boss between a registered pair of negative draft boss defining dies on the respective sides of the sheet, closing the dies and thus forcing the boss partially through the sheet while reforming its outer surfaces into negative draft opposed bosses, and stripping the bosses from the dies.

Still another aspect of the invention is the provision of novel stripping devices and methods for automatically removing a molding from a mold of the type described above as a result of opening the mold and withdrawing the slide. One stripping device is one or more spring-loaded pins which retract into a land when the mold is closed and extend from the land to bear against the slide, thus separating them, when the mold is opened slightly. Another stripping device is an insert secured to a land and having a bevel in its edge which is furthest from the slide withdrawing means. The slide is slotted to receive each insert during molding, and the slot has a beveled edge corresponding to and adjacent the first beveled edge. When the slide is withdrawn it rides up on the insert, urging the slide and land apart. Still another stripping means is a method wherein the slide is withdrawn when the mold is opened slightly, but not sufficiently to clear the molded part so the part bears against the mold to strip the part from the slide. These stripping devices and methods can be used independently or together to strip a part from a mold.

Even another aspect of the invention is an improved die set for forming a living hinge having a thinner flexing web than was possible using prior art dies and working methods.

DETAILED DESCRIPTION OF THE PREFERRED EMBODIMENTS

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

Figure 1:
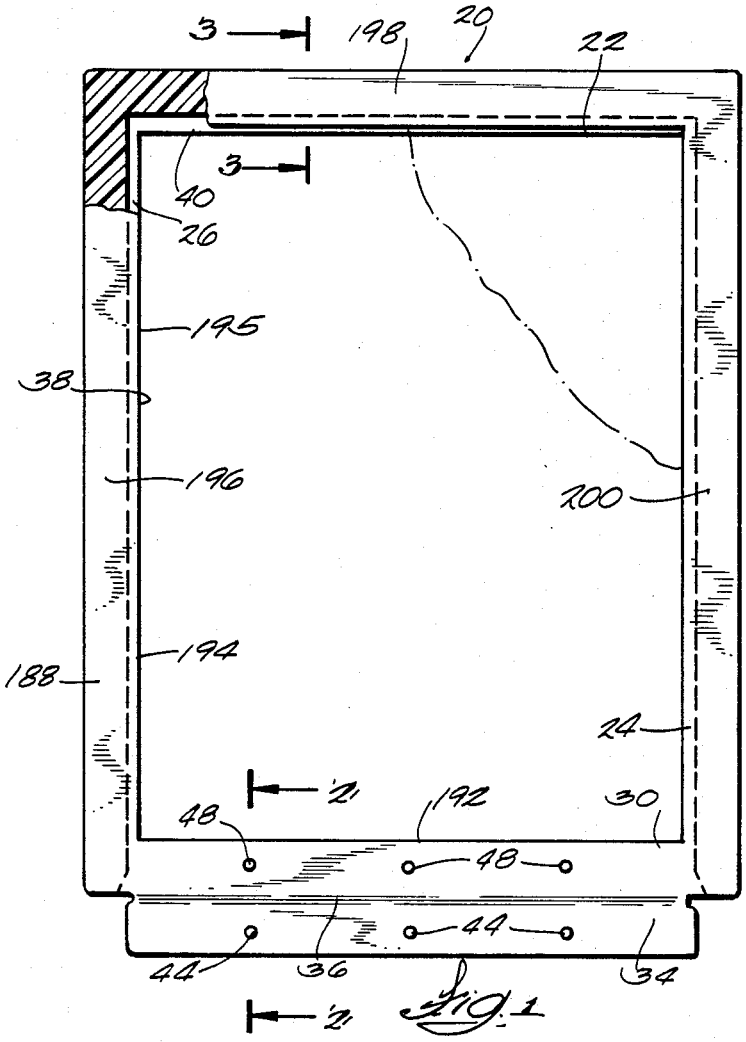
FIG. 1 is a face elevation of an album page according to the present invention, with one corner broken away to show internal structure.
Figure 2:
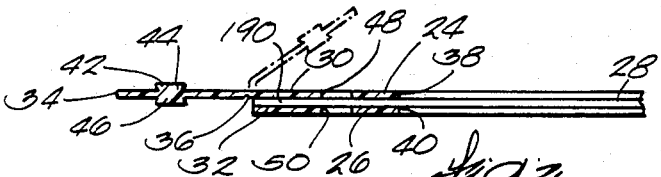
FIG. 2 is an enlarged fragmentary cross-sectional view taken along line 2—2 of FIG. 1.
Figure 3:
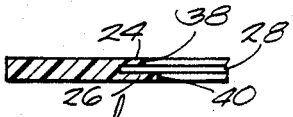
FIG. 3 is an enlarged fragmentary cross-sectional view taken along line 3—3 of FIG. 1, showing the construction of the free edge of the page.

Referring first to FIGS. 1, 2, and 3, album page 20 for receiving and displaying a flat object such as picture 22 (which can also be two pictures glued back to back) comprises first and second leaves 24 and 26 joined along three edges to form a pocket 28 between them. Pocket 28 has first and second opposed lips 30 and 32 through which picture 22 can be inserted. A flap 34 is secured to first lip 30 by an integral living hinge 36 which can flex from the straight position shown in full lines in FIG. 2 to the folded position shown in phantom, and further to a full 180 degrees to bring it parallel to the body of the page.

Page 20 is provided with windows 38 and 40. (A "window" is defined here as an opening which admits a view.) Windows 38 and 40 are generally in registration, except that the edge of window 40 opposite hinge 36 overlaps the corresponding edge of window 38 slightly to guide a picture 22 between the leaves in that region during insertion. Windows 38 and 40 as shown herein are so extensive that the page can alternately be described as a rectangular frame 188 having a slot 190 through one member 192 for admitting a picture and a continuous track 194 coplanar with said slot in the inside edge 195 of the other three members (196, 198, 200) for receiving the leading and side edges of an inserted picture 22.

Figure 13:
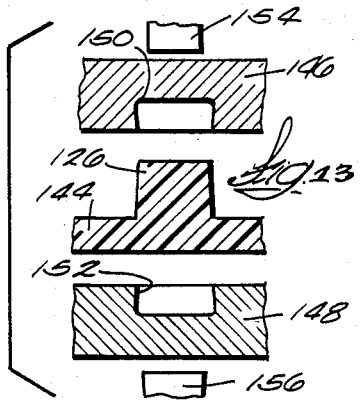
FIGS. 13, 14, and 15 are enlarged schematic cross-sectional views showing the steps of forming a registered pair of negative draft bosses in a thermoplastic sheet.

Flap 34 includes three first fastening means 42, each comprising at least one boss 44, and here a registered pair of bosses 44 and 46 formed with a negative draft (shown enlarged in FIG. 13). Second lip 32, and in this embodiment first lip 30 as well, includes second fastening means 48, 50 for receiving the bosses 44, 46 of another page to secure the flap 34 of the latter page to the former page. In this embodiment flap 34 of each page is inserted in the picture insertion opening between the lips 30 and 32 of the adjacent page and bosses 44 and 46 respectively snap into the perforations 50 and 48, preventing lips 30 and 32 from being spread apart when the individual pages are assembled into an album.

In this embodiment the pictures can be removed from a particular page or frame, without damaging the page or the pictures, by removing the flap of the adjacent page from the insertion opening of the subject page and removing or inserting pictures through the same opening. The rigidity of each page is increased by gluing a pair of pictures back to back for insertion.

Figure 4:
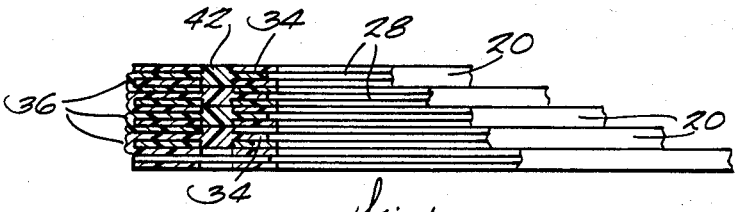
FIG. 4 is a view similar to FIG. 2, showing individual pages assembled to form an album.

Referring now to FIG. 4, the pages 20 shown in FIGS. 1, 2, and 3 can be assembled into an album without requiring any other hardware. Although the scale of FIG. 4 does not permit a full showing of reference characters, FIG. 4 simply shows plural pages aligned as in FIG. 2, except that each flap 34 is folded at its offset hinge 36 and inserted between the lips 30 and 32 of the adjacent page, its bosses 44 and 46 being snapped into perforations 50 and 48 to flexibly secure each page to the subsequent one. When the album is opened, only the hinge corresponding to the page to which the album is opened is flexed, and the other hinges and pages do not interfere. Thus, when the album is opened to any page, the album will lie flat, even if the sight area is substantially rigid (as in the preferred embodiment). Each hinge is stressed when the corresponding page is closed and relaxed when it is opened. The hinges are sufficiently flexible that the weight of a particularly page is sufficient to keep its hinge folded over completely. Thus, the book does not tend to spring open.

Some preferred dimensions of the structure shown in FIG. 1 are as follows: the outside thickness of each envelope is 0.0625 inches (1.56 millimeters); flap 34 has a thickness of 0.025 inches (0.64 millimeters); the separation of lips 30 and 32 is also about 0.025 inches (0.64 millimeters) and the lips are 0.018 inches (0.46 millimeters) thick; the flap and first lip of a given page are offset by about 0.026 inches (0.66 millimeters) when the flap is folded parallel to the body of the page; the bosses 44 and 46 each have a height of about 0.018 inches (0.46 millimeters), a negative draft angle of about 15 degrees, and a land diameter of about 0.125 inches (3.2 millimeters). Second fastening means 48 and 50 each have a positive draft angle of about 15 degrees and a diameter at their larger or outside edge of 0.125 inches (3.2 millimeters).

FIGS. 5 through 10 illustrate the mold assembly and molding method which is preferred for forming envelopes 20. Mold assembly 60 comprises a first mold portion 62 and a second mold portion 64 enclosing a cavity 66 for forming the external surfaces of a page (including the flap). A slide 68 displaces material within cavity 66 to form a pocket within the page. In this embodiment one portion—here second portion 64—is fixed and the other portion—here first portion 62—is movable by first portion control means schematically indicated at 70. Slide 68 is transversely movable from the inserted position shown in FIGS. 5 through 8 to the withdrawn position indicated in FIG. 10 by a double acting outboard hydraulic system schematically indicated at 72, supported on the first portion 62 of the mold. System 72 has a ram 74 for moving a block 76 to which slide 68 is secured by fasteners 78. The parts of the mold are aligned by alignment pins such as 80 anchored in first portion 62 and received in bores such as 81 formed in second portion 64.

Slide 68 is guided and supported in the mold as follows. Guides 82 have guide slots 84 which slidably receive the edges 86 of slide 68 to prevent it from being moved out of its plane. The portion of slide 68 in the window region of the mold is supported by registered lands 88 and 90 in the respective mold portions, best seen in FIG. 10. When the mold is closed, lands 88 and 90 bear against the respective faces 92 and 94 of slide 68. In this embodiment first and second portions 62 and 64 also have substantial lands 96 and 98, again best seen in FIG. 10, which bear against the respective surfaces of slide 68 when the mold is closed. In the region between lands 88 and 96, and in the corresponding region between lands 90 and 98, raised pins such as 100 (for forming second fastening means 48 and 50) are provided in registered pairs, as are pins 102 (which form nonfunctional perforations). Pins 100 and 102 extend from the respective mold portions to support the corresponding region of slide 68 when the mold is closed.

The mold assembly 60 shown in the figures further comprises injection means for introducing moldable material into cavity 66 during molding. The injection means generally indicated at 104 comprises a reservoir of moldable material schematically indicated at 106, a hot sprue 108 communicating between reservoir 106 and cavity 66, and a gate 110 which perforates slide 68 for allowing the moldable material to pass through the slide for better distribution within the mold. As will be seen below, gate 110 does not interfere with the removal of slide 68, as slide 68 is drawn from the mold with sufficient force to shear off and remove the material within gate 110.

Figures 5, 6:
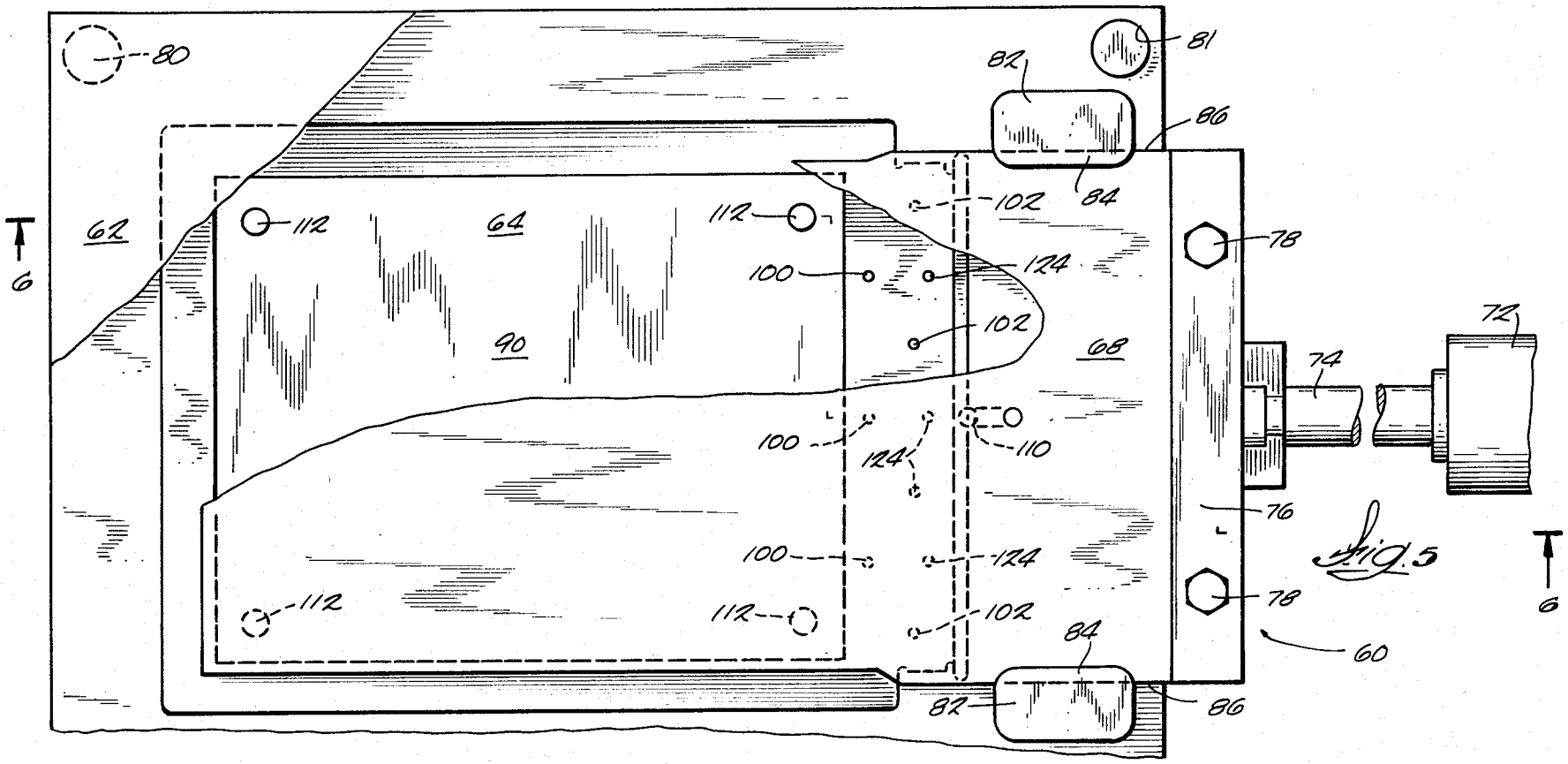
FIG. 5 is a side elevation of a mold for forming a page as shown in the previous figures, with parts broken away to show underlying structure.
FIG. 6 is a cross-sectional view taken along line 6—6 of FIG. 5.

Mold assembly 60 further comprises various stripping means for stripping a page molding from the mold. One aspect of the stripping means is withdrawal means 72 for withdrawing slide 68 from the molded part when the mold is partially open, as further described below. Another aspect of the stripping means is plural spring loaded stripping pin assemblies 112, here positioned at each corner of land 88. Each stripping pin assembly 112 comprises a shouldered bore 114 in upper mold portion 62 closed off at its larger end by a plate 116, a pin 118 having a head and shaft slidably received in bore 114, and a compression spring 120 confined between plate 116 and pin 118 and tending to urge the head of pin 118 against the shoulder of bore 114. The force exerted by spring 120 is less than the closing force exerted by first portion control means 70, so that when the mold is closed as shown in FIG. 6 the pins 118 bear against slide 68 and are retracted into bores 114. As the mold is partially opened by withdrawing first portion 62 away from second portion 64, pins 118 protrude from bores 114, stripping the part from first portion 62 and preventing slide 68 from being bent due to adhesion of the molded material to the face 92 of slide 68 and the opposed inner face 112 of first portion 62.

Figure 11:
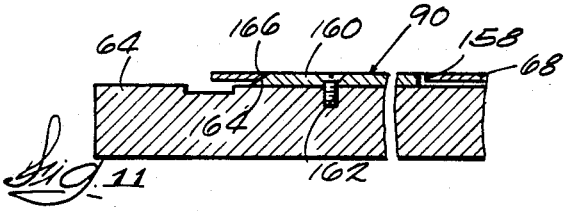
FIGS. 11 and 12 are schematic fragmentary views similar to FIGS. 8 and 9 but showing another embodiment of the invention.
Figure 12:
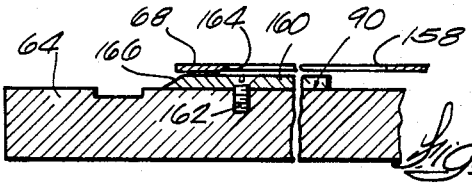

Although no stripping means are shown in the figures previously discussed for removing the molding from second mold portion 64, such means are very desirable to permit the molding to drop out of mold assembly 60 automatically (providing the mold portions separate horizontally). FIGS. 11 and 12 schematically show an alternate embodiment of second mold portion 64 and slide 68 which can provide automatic stripping from portion 64. Slide 68 is provided with one or more slots 158 extending parallel to the direction of withdrawing slide 68 from the mold. An insert 160 substantially congruent to each slot 158 is secured by fasteners 162 to land 90. The slot wall 164 and corresponding insert wall 166 furthest from the slide withdrawing means 72 are beveled. Before slide 98 is withdrawn (as in FIGS. 6, 7, and 8 above), each insert 160 substantially fills the corresponding slot 158. As slide 68 is withdrawn (as in FIG. 12, corresponding to FIG. 9 above), beveled wall 164 bears against beveled wall 166, causing slide 68 to ride over insert 160 and pull molding 128 away from second portion 64. Molding 128 is thus stripped from second mold portion 64, and drops out when the slide is withdrawn and the mold is opened further. In this embodiment the mold is opened slightly further before withdrawing slide 68 to allow additional clearance between pins 118 and slide 68.

It will be observed that cavities 124 for forming each boss 44 are provided in first portion 62, but no corresponding cavities are provided in second portion 64 for forming the registered boss 46. That is because each cavity 124 is adapted for forming the single boss 126 shown in FIG. 11, which is further worked as explained below to form a registered pair of negative draft bosses extending from the respective faces of flap 34.

Now, referring in particular to FIGS. 7 through 10, the molding method preferred for use herein can be explained, and also will serve to further illustrate the molding apparatus shown herein.

Figure 7:
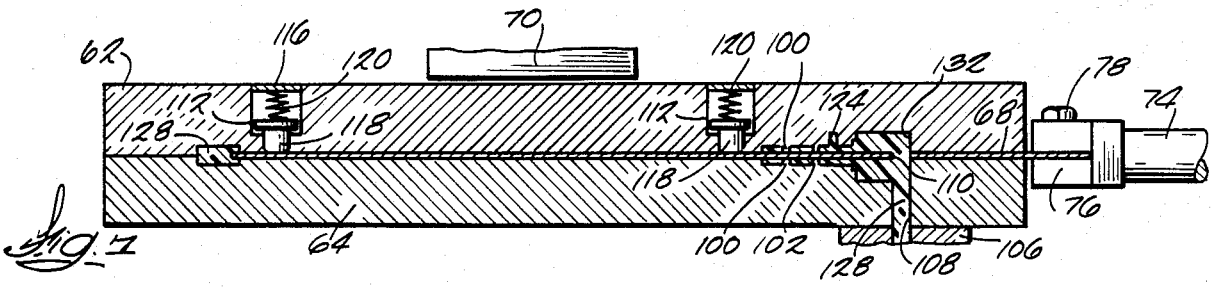
FIG. 7 is a view similar to FIG. 6, showing the mold after material has been injected.

FIG. 7 shows first and second mold portions 62 and 64 completely closed together, slide 68 fully inserted between them, pins 118 withdrawn into their respective bores, and a charge of thermoplastic material forming a molding 128 completely filling cavity 66, sprue 108, and gate 110 of the mold.

Figure 8:
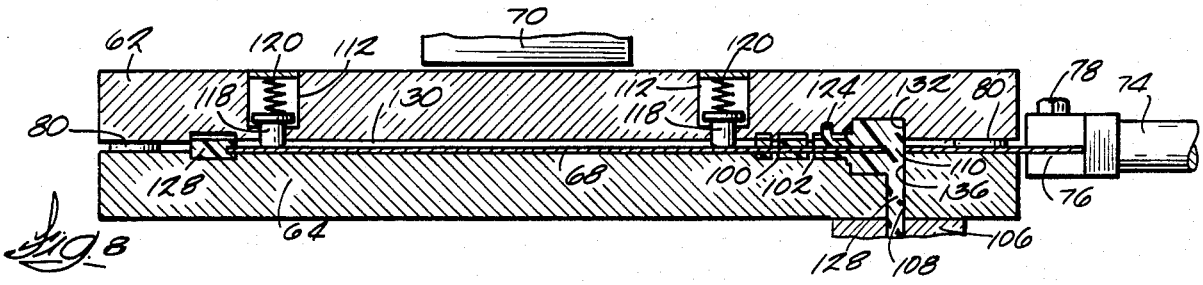
FIG. 8 is a view similar to FIG. 7, showing the mold opened slightly and the slide stripped from the upper portion of the mold.

FIG. 8 shows the first step in removing molding 128 from the mold. The mold is opened just slightly by first portion control means 70, allowing some clearance 130 between first portion 62 and molding 128. At the stage shown in FIG. 8, pins 118 still bear between first portion 62 and slide 68 to strip molding 128 from upper portion 62 as explained before. The mold is opened less than the thickness of at least a portion of said cavity to strip first portion 62 from molding 128 so portions of molding 128 are in abutment with surfaces 132, 134, 136, 138.

Figure 9:
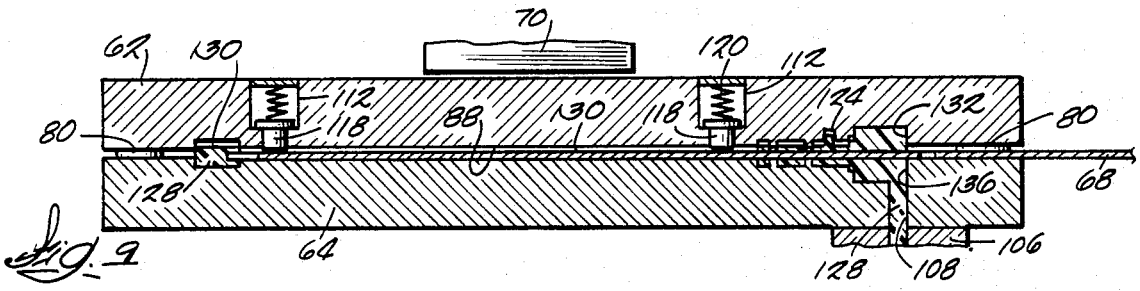
FIG. 9 is a view similar to FIG. 8, showing the slide partially withdrawn from the mold.

FIG. 9 is identical to FIG. 8, except that the mold has been opened slightly further to move pins 118 clear of slide 68, and slide 68 has been partially withdrawn. The abutting surfaces of the partially opened mold keep molding 128 in place and prevent it from being distorted as slide 68 is removed. Removing the slide shears off the portion of molding 128 within gate 110.

Figure 10:
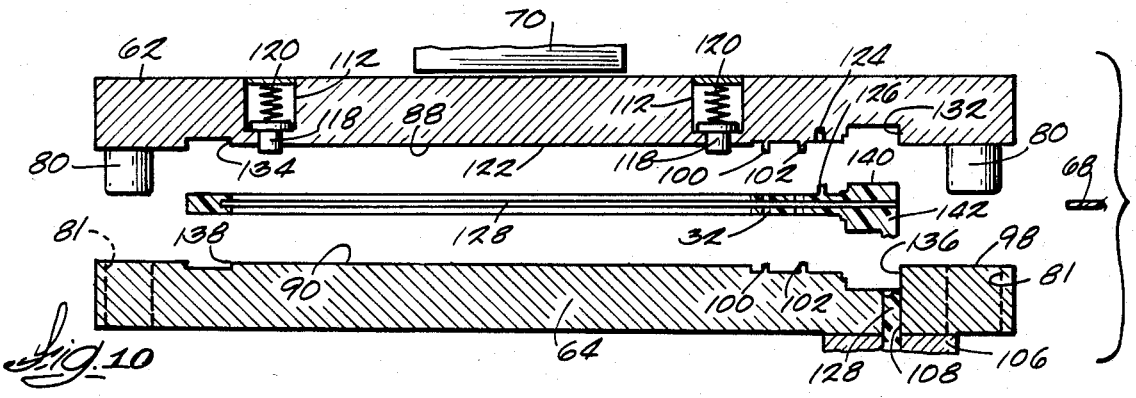
FIG. 10 is a view similar to FIG. 9, showing the mold fully opened, the slide withdrawn, and the molding stripped from the mold.

As shown in FIG. 10, as slide 68 is withdrawn the mold is opened completely, pulling molding 128 off the hot sprue 108.

After the molding process is complete runner 140 is trimmed off, and lower lip 32 is trimmed back to the outside of the frame to remove runner 142 and the part underlying flap 34.

Figure 14:
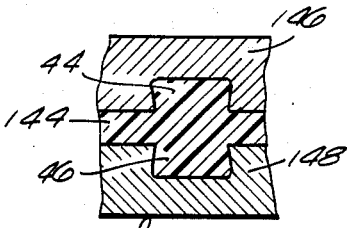
Figure 15:
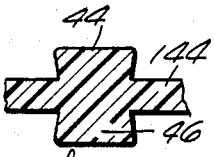

The next procedure in forming the completed page 20 is the formation of negative draft bosses 44 and 46 from the one-sided bosses 126 as molded. First, a sheet 114 of material having a single boss (here a portion of molding 128) is provided. Next, as illustrated in FIG. 13, sheet 144 is placed between a registered pair of dies 146 and 148, the die cavities 150 and 152 of which have negative drafts. The dies are then brought together by suitable press means 154, 156 to the position shown in FIG. 14. The sheet 144 is subsequently stripped from the dies to form the completed structure shown in FIG. 15. It will be evident from the figures that the material of boss 126 and the adjacent sheet material is reformed as a mass of material centered between and confined within die cavities 150 and 152 to define bosses 44 and 46. Under the proper working conditions bosses 44 and 46 will not lose their negative draft when removed from die cavities 150 and 152 because the bosses can be sufficiently resilient to be unsnapped from the dies.

The final step in manufacturing page 20 is to form living hinge 36. Although it would be possible to form a living hinge using conventional means, in the preferred embodiment hinge 36 is novel, and formed by confining the respective sides of flap 34 between a pair of hinge forming dies of novel construction.

Figure 16:
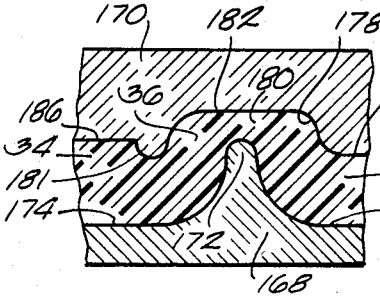
FIG. 16 is a greatly enlarged cross-section of the hinge shown in FIG. 2, in association with the die set for forming it.

FIG. 16 is a greatly enlarged view of hinge 36 and the novel hinge dies 168 and 170 for forming the hinge. Die 168 has a central nose or ridge 172, which is conventional, and perpendicular wing surfaces 174 and 176, which are believed to be new. Die 170 has a novel well 178 centered over ridge 172. (Prior dies 170 have been flat anvils or have comprised an opposed ridge in registration with ridge 172.) Die 170 also includes an offset ridge 181 at one edge of well 178.

Looking at hinge 36 in more detail, it comprises a first leaf which is flap 34, a second leaf which is lip 30, and an apex 180 which folds as the hinge is flexed (flap 34 is folded clockwise in normal use). The inside surface 182 is offset from the corresponding surfaces 184 and 186 of lip 30 and flap 34, which allows a substantial offset between the leaves of the hinge when folded 180 degrees. This offset is needed when flap 34 is inserted between the lips of an adjacent page 20 to span the thickness of one of those lips, as illustrated in FIG. 4.

The novel configuration of hinge 36 and the dies 168 and 170 for forming it permits the hinge to be much thinner at apex 182, and thus more flexible, while avoiding the tendency to sever an extremely thin hinge while it is being formed. While conventional dies for forming living hinges (as described above) tend to stretch apex 182 greatly while the hinge is formed, the present well 178, opposed surfaces 176 and 184, and opposed surfaces 174 and 186 resist excess flow of material away from apex 180, thus greatly reducing the stretching forces within apex 180. The tendency of apex 180 to crack or be severed is thus greatly reduced, and the prior art minimum thickness at apex 180 of about 0.010 inches (0.25 millimeters) can be reduced to 0.0035 inches (0.089 millimeters), as preferred in the present invention, or even further. This improvement in dies thus allows formation of much more flexible hinges than are taught in the prior art.

The primary reason for providing different elevations for surfaces 184 and 186, and the corresponding surfaces of die 170, is to accommodate the different preferred thicknesses of lip 30 and flap 34.

The steps of forming bosses 44 and 46 and forming hinge 36 can be combined, thus reducing the number of operations required to complete the page, by providing dies 146 and 170 as one die and by providing dies 148 and 168 as a single opposing die.

I claim:

1. A one piece molded album page for displaying a flat object, comprising:

A. a rectangular frame comprising four edge members;

B. a track in the inside edge of three of the edge members, said track defining a space into which a leading, and side edges of a flat object to be displayed are received and retained;

C. a slot in the remaining edge member, coplanar with and in communication with said track, said slot dividing said remaining edge member into first and second opposing lips, said slot defining a space into which a trailing edge of a flat object to be displayed is received and retained;

D. a flap, extending outwardly from and generally parallel to the said remaining edge member, said flap secured to said first opposing lip by a flexible integral hinge, and;

E. means for fastening said flap onto a second opposing lip of another album page, said flap including a first fastening means and said second opposing lip of another page including a second fastening means.

2. The album page of claim 1, wherein said first fastening means comprises at least one boss having a negative draft and secured to said flap.

3. The album page of claim 2, wherein said second fastening means comprises at least one perforation in said second lip for receiving the boss of the flap of another said album page.

4. The album page of claim 1, wherein said first and second lips are in registration for receiving and securing between them the flap of another said album page.

5. The album page of claim 4, wherein said flap includes first fastening means and said lips include second fastening means for being secured to the first fastening means of the flap of another said album page.

6. The album page of claim 5, wherein said first fastening means comprises at least one registered pair of bosses, each boss having a negative draft.

7. The album page of claim 6, wherein said second fastening means comprises at least one registered pair of perforations in the respective lips for receiving at least one registered pair of bosses of the flap of another said album page.

8. An album assembly for displaying flat objects, said album assembly composed of a plurality of one piece molded album pages, each album page comprising A. a rectangular frame comprising four edge members;

B. a track in the inside edge of three of the edge members, said track defining a space into which a leading, and side edges of a flat object to be displayed are received and retained;

C. a slot in the remaining edge member, coplanar with and in communication with said track, said slot dividing said remaining edge member into first and second opposing lips, said slot defining a space into which a trailing edge of a flat object to be displayed is received and retained;

D. a flap, extending outwardly from and generally parallel to the said remaining edge member, said flap secured to said first opposing lip by a flexible integral hinge, and;

E. means for fastening said flap onto a second opposing lip of another album page, said flap including a first fastening means and said second opposed lip of another album page including a second fastening means.

whereby, the flap of each album page can be fastened to the lip of a succeeding album page and folded along said flexible integral hinge, bringing each album page into registration with a succeeding album page to progressively form an album assembly.

* * * * *